US007597471B2

(12) United States Patent
Perret et al.

(10) Patent No.: US 7,597,471 B2
(45) Date of Patent: Oct. 6, 2009

(54) TIME PIECE CHRONOGRAPH CLOCKWORK MOVEMENT

(75) Inventors: Laurent Perret, La Chaux-de-Fonds (CH); Stephen Forsey, Le Locle (CH)

(73) Assignees: Vaucher Manufacture Fleurier S.A., Fleurier (CH); CompliTime SA, La Chaux-de-Fonds (CH)

( * ) Notice: Subject to any disclaimer, the term of this patent is extended or adjusted under 35 U.S.C. 154(b) by 0 days.

(21) Appl. No.: 12/094,792

(22) PCT Filed: Nov. 21, 2004

(86) PCT No.: PCT/EP2006/068693

§ 371 (c)(1),
(2), (4) Date: May 23, 2008

(87) PCT Pub. No.: WO2007/060151

PCT Pub. Date: May 31, 2007

(65) Prior Publication Data

US 2008/0310257 A1 Dec. 18, 2008

(30) Foreign Application Priority Data

Nov. 24, 2005 (EP) ..... 05111268

(51) Int. Cl.
*G04F 7/00* (2006.01)

(52) U.S. Cl. ..... 368/101; 368/106

(58) Field of Classification Search ..... 368/89, 368/101–106, 110, 112, 113
See application file for complete search history.

(56) References Cited

U.S. PATENT DOCUMENTS

| | | | | |
|---|---|---|---|---|
| 3,568,432 | A | 3/1971 | Dubois et al. | |
| 3,910,362 | A | 10/1975 | Piguet et al. | |
| 5,220,541 | A | 6/1993 | Vuilleumier | |
| 5,793,708 | A | 8/1998 | Schmidt et al. | |
| 6,406,176 | B1 * | 6/2002 | Takahashi et al. | 368/101 |
| 6,428,201 | B1 * | 8/2002 | Shibuya et al. | 368/106 |
| 6,926,438 | B2 * | 8/2005 | Girardin | 368/103 |
| 7,029,169 | B2 * | 4/2006 | Takahashi et al. | 368/106 |

* cited by examiner

*Primary Examiner*—Vit W Miska
(74) *Attorney, Agent, or Firm*—Young & Thompson

(57) ABSTRACT

A chronograph clockwork movement for measuring time includes a control lever actuatable by a first control member for alternatively activating or deactivating a time measurement, clutch elements for driving or not a second timer in response to an action produced on the control lever and selective locking members for locking the second timer in response to an action produced on the control lever. A lever and a hammer for resetting the second timer to zero are also provided. The clockwork movement is arranged in such a way that a user does not feel any difference, while measuring a time, whether the second timer is pre-set or not. The clockwork movement has a structure enabling to activate time measuring by delaying the effective departure of the second timer until an external resetting device controlling the lever is released in the rest position thereof.

10 Claims, 3 Drawing Sheets

TIME PIECE CHRONOGRAPH CLOCKWORK MOVEMENT

TECHNICAL FIELD

The present invention concerns a chronograph movement for time measuring comprising:

a going train, at least one second counter comprising a chronograph second mobile designed to support an analog display organ for measured seconds, a control lever designed to be actuated by a first control member to alternatively activate or deactivate the time measurement.

In a known manner, this chronograph movement also comprises coupling means to connect or not the second wheel to the going train in response to an action on the control lever, and selective locking means for locking the second counter in response to an action on the control lever.

Moreover, return-to-zero means for the second counter are also provided, these return-to-zero means comprising at least one mobile return-to-zero element designed to be moved by a second control member, at least between a first, locking position and a second, active position, the mobile return-to-zero element being configured to act on the second counter in the second active position.

More precisely, the mobile return-to-zero element is generally made in the form of a hammer cooperating with a heart-shaped cam integral with the second counter.

STATE OF THE ART

A number of chronograph movements meeting the above definition are known from the prior art.

Conventionally, the chronograph movement comprises a control lever moved under the impulse of an external control member and acting on a rotating control element to start or stop a time measurement.

Likewise, the return-to-zero hammer is moved into contact with the corresponding heart under the effect of an action exerted on an external return-to-zero push-piece. The return-to-zero hammer then remains bearing against the heart, in its locking position, while a new unlocking of the chronograph is not ordered, with the goal of maintaining the hand indicating measured time in its initial position. Thus, it is provided that the return of the hammer into its raised or armed position, to release the indicator hand, is caused by an action on the control lever whereof the primary aim is to start a time measurement. In fact, the rotating control element, of the two-level cam or column wheel type, typically has a projecting region brought into contact with a part of the hammer and driving the rotation thereof to bring it back to its armed position. This rotational movement is then done while overcoming the pressure of a spring arranged bearing against a part of the hammer to maintain it firmly against the heart when a time measurement is not in progress.

However, these conventional chronograph movements have some aspects which are open to improvement. One of these aspects rests on the fact that, in general, when an external return-to-zero member is maintained in its pressed-in position, raising of the return-to-zero lever to its armed position is not possible. As a result, a rotation of the rotating control element is generally not possible while the return-to-zero push-piece is pressed in, due to the mechanical connection between the hammer and the rotating control element mentioned above. Thus, the external control member acting on the control lever is neutralized and cannot be actuated. The result is that the manipulation of the external control members can only be done sequentially, the corresponding pressures of the user being validated by the implementation of conventional notchings.

Moreover, the first start-up of the time measurement, caused by an action on the control lever, requires an additional effort to overcome the force of the spring serving to keep the hammer lowered, in addition to activating the time measurement mechanisms as such. Thus, when the user stops the time measurement at a given moment, then starts it again without having previously reset the counter(s) to zero, the sensation the user feels upon pressing the control member is different from that felt during the first start-up. In this configuration, in fact, the hammer not having been released to return the counters to zero, the force of its supporting spring does not need to be overcome to restart the time measurement mechanism.

BRIEF DESCRIPTION OF THE INVENTION

The present invention aims in particular to offset the above-mentioned drawback of the prior art by proposing a chronograph movement having a structure which makes it possible to activate a time measurement while also maintaining the counter for the measured unit of time in its initial position while the external return-to-zero mechanism is not released in its locking position. Thus, the effective start-up of a time measurement takes place at the moment when the user of the watch, in which the chronograph movement according to the present invention is implemented, releases the return-to-zero push-piece. A characteristic of this type results in increased precision of the triggering of the measurement by the user since this user does not have a provide a force of minimal intensity needed to cross a notching, as is the case for the known movements of the prior art.

An additional aim of the present invention is to improve the sensation felt by the user of a chronograph at the time of activation of a time measurement. In particular, one aim of the present invention is to propose a chronograph movement thanks to which the user does not feel any difference upon activation of the time measurement depending on whether or not the counters of measured units of time have been previously returned to zero. An aim of this type is achieved in particular thanks to the fact that the mobile return-to-zero element has a locking position in which it is not arranged in contact with the chronograph counters and is not coupled to the column wheel.

To this end, the invention relates to a chronograph movement of the type indicated above, characterized by the fact that it also comprises elastic means exerting a return force on the return-to-zero means, and by the fact that the movements of the mobile return-to-zero elements are controlled exclusively by the second control member, from the locking position toward the active position, and by the elastic means, from the active position toward the locking position.

BRIEF DESCRIPTION OF THE DRAWINGS

Other characteristics and advantages of the present invention will appear more clearly upon reading the detailed description of one preferred embodiment which follows, done in reference to the appended drawings provided as non-limiting examples and in which.

DETAILED DESCRIPTION OF THE INVENTION

The timepiece chronograph clockwork movement according to the present invention is designed to be arranged in a chronograph watch with analog display (not shown) of the conventional type.

A watch of this type comprises in particular at least one organ for displaying a unit of measured time, generally seconds. In the preferred embodiment as shown and described in the continuation of the text, the clockwork movement comprises a minute counter to drive a display organ for measured minutes, in a manner known in the state of the art, in addition to a second counter to drive the display organ for measured seconds.

Figure 1:
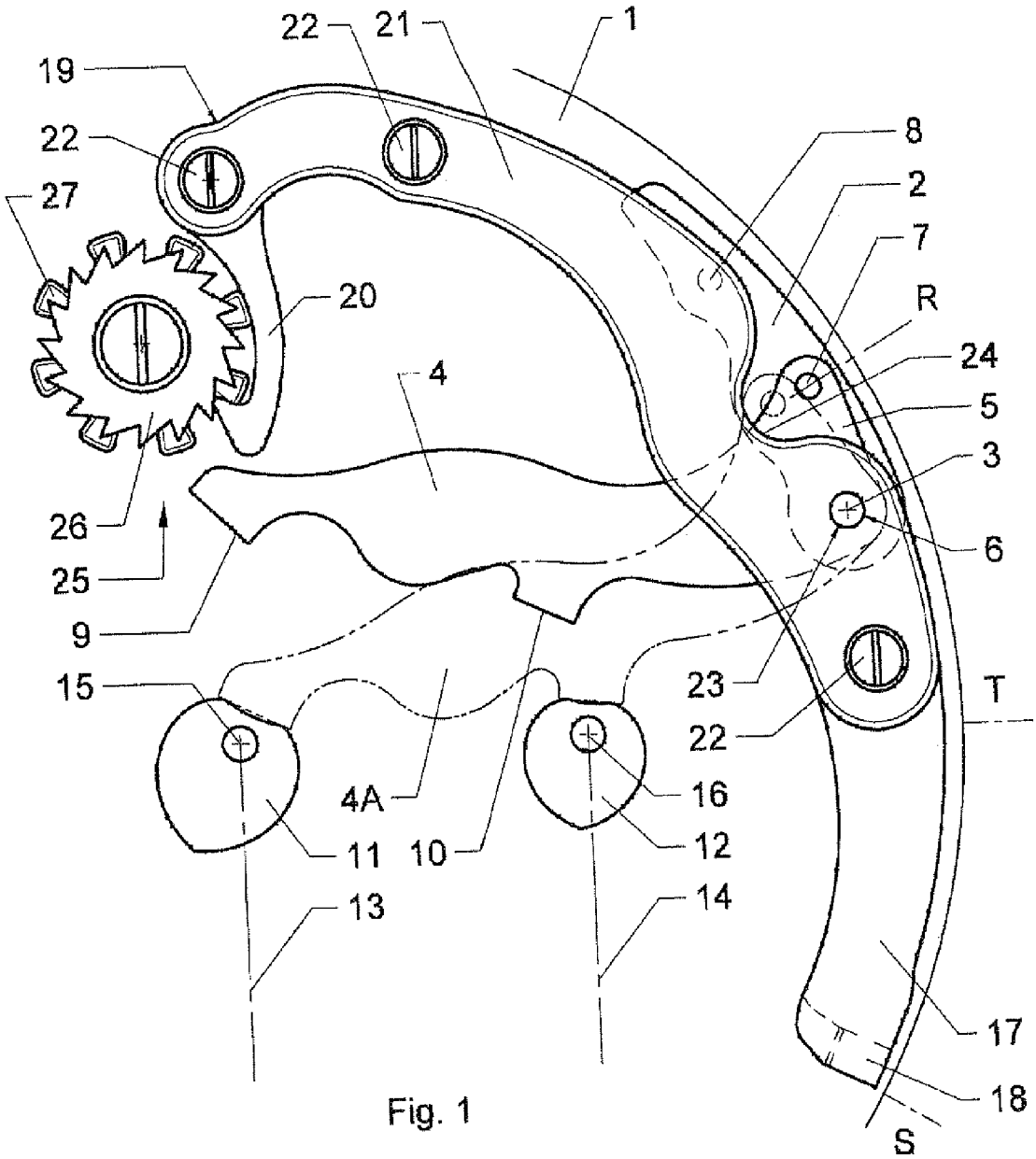
FIG. 1 shows a simplified top view of one part of the chronograph movement according to a first preferred embodiment of the invention.
Figure 2:
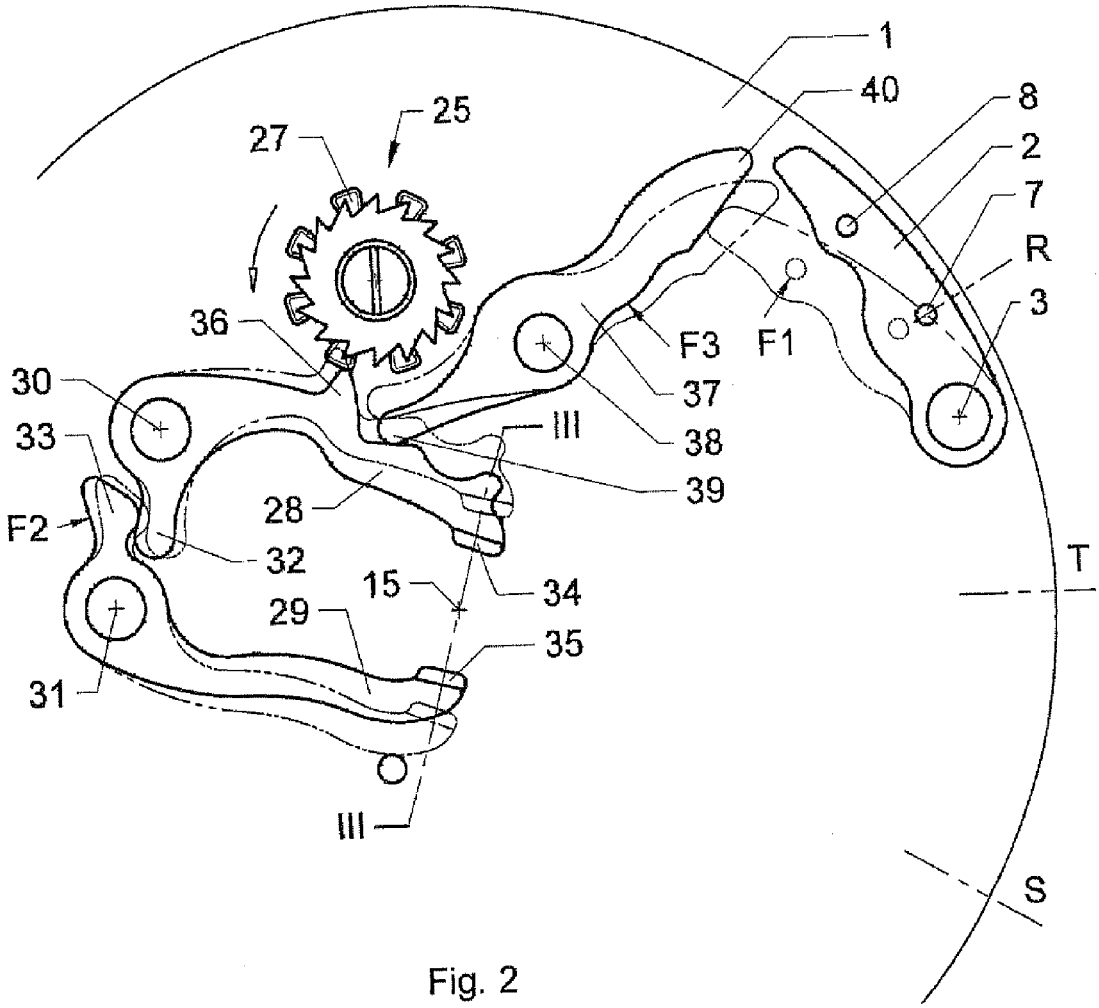
FIG. 2 is a view similar to that of FIG. 1, in which the additional components of the chronograph movement of FIG. 1 have been shown.

FIGS. 1 and 2 are simplified illustrations of the component elements of the clockwork movement according to the present invention coming into play during the activation or deactivation of the chronograph function or during the return-to-zero of the second and minute counters. Only the elements of the clockwork movement which are essential to a good understanding of the invention have been shown out of a concern for clarity.

Also, in the following description, the position of certain components is sometimes defined in reference to an hour. This position corresponds to that occupied, on a conventional dial, by the index displaying the given hour.

In FIGS. 1 and 2, a peripheral portion of the plate 1 of the movement has been shown in the region designed to cooperate with the external control members (not shown) in the corresponding timepiece. A return-to-zero lever 2 is arranged to be actuated by an external return-to-zero control member, diagrammed by an axis line bearing the reference R in the figures. More precisely, the lever 2 has a pivot-type connection with the plate 1 and follows a rotational movement relative to the plate in response to a pressure exerted on the external control member. The pivot-type connection is provided by an axis or post 3 which can be press-fitted in a hole (not shown) of the plate having corresponding dimensions.

The position of a setting organ or stem (not shown) has also been diagrammed by an axis line bearing the reference T. Likewise, the position of an additional control member has been diagrammed by an axis line bearing the reference S, this control member being designed to activate or deactivate the chronograph function. As non-limiting information, one can note that, when the clockwork movement is mounted in a case to assemble a timepiece, the axis R is positioned at four o'clock while the axis T is positioned at three o'clock and the axis S at two o'clock.

A return-to-zero hammer 4 is mounted integral with the return-to-zero lever 2, by its base 5, so as to be moved in response to an action on the external return-to-zero control member.

The nature of the movement of the hammer 4 is not directly connected to the present invention and can be of any type adapted to the implementation of this invention. Thus, in the present embodiment, the lever 2 is arranged so as to be able to pivot in relation to the plate 1 of the clockwork movement, like the return-to-zero hammer 4. One sees in particular, in FIG. 1, that the base 5 of the hammer 4 comprises a hole 6 inside which is arranged the post 3, this post thereby also constituting an axis of rotation for the hammer 4.

The lever 2 and the hammer 4 can be made integral using any adapted means making it possible to ensure the transmission of a rotation of the return-to-zero lever 2 to the hammer 4, without going outside the scope of the present invention.

According to one preferred embodiment of the present invention, as visible in FIG. 1, the return-to-zero lever 2 is provided with a pin 7 press-fitted in a hole (not referenced) arranged in the region of the lever 2 located in superimposition relative to the base 5 of the hammer. The base 5 also comprises a hole adapted to house the pin 7 and thereby make the hammer 4 integral with the return-to-zero lever 2 during rotational movements.

The return-to-zero lever 2 comprises an additional pin 8, in its part remote from the post 3, designed to serve as support for the end of a spring (not shown) exerting a force, diagrammed by an arrow referenced by F1 in FIG. 2, on the lever 2, this force tending to maintain the lever in its locking position, i.e. in the position shown in thick lines in FIG. 1. One preferably provides a notching done conventionally on the spring to allow rapid action of the return-to-zero control.

The hammer 4 is provided with support surfaces 9 and 10, two in number in the embodiment shown in the figures non-limitingly, designed to be moved into contact with hearts 11 and 12 when the chronograph counters are returned to zero.

The hearts 11 and 12 were illustrated diagrammatically insofar as they are conventional and do not present any particular difficulty for one skilled in the art. Each of the hearts is mounted on a counter mobile (not shown in FIGS. 1 and 2 for more clarity) supporting a hand indicating a timed unit of time.

Thus, a hand 13 indicating timed seconds and a hand 14 indicating timed minutes have been diagrammed in the figures. The hands 13 and 14 were illustrated in their initial positions in FIG. 1, which corresponds to a stopped situation after return-to-zero of the chronograph function. The hammer 4 is shown in solid lines in its raised position to allow any rotation of the hearts 11, 12 of the chronograph mobiles relative to their respective axes of rotation 15 and 16. We have also shown the hammer, in thin lines with the reference 4A, when it is actuated by the lever 2 to return the chronograph counters to zero, the hearts 11 and 12 then being oriented according to FIG. 1.

One can see that the timed second mobile is, commonly, arranged at the center of the clockwork movement, the indication of the timed second being done by a large second hand centered on the chronograph dial. In this case, which corresponds to the embodiment shown in the figures, the axis of rotation 15 is merged with that of the movement.

We have also shown a control device in FIG. 1 designed to initiate or stop time measurements.

The control device of the clockwork movement according to the present invention in particular comprises a control lever 17 extending substantially between the two o'clock and six o'clock positions, bordering the periphery of the plate 1. The general production of the control lever 17 is conventional.

A first end 18 of the control lever, arranged at two o'clock, is located across from the external control member when the movement is housed in a case of the timepiece.

The second end 19 of the control lever bears an operating-lever hook 20 of the type known in the state of the art. In accordance with the preferred embodiment shown and described, the control device comprises a small plate 21 made integral with the control lever 17 using a plurality of screws 22. The small plate 21 has a shape such that it superimposes a significant part of the control lever, substantially from the three o'clock position to the second end 19. One of the screws 22, arranged at the level of the second end 19 of the control lever, goes through an adapted hole (not visible) arranged in the operating-lever hook 20 to make the latter part integral both with the control lever 17 and the small plate 21, while also being free to pivot with a small amplitude relative to the axis of the screw 22.

Preferably, one or several empty spaces are arranged between the control lever 17 and the small plate 21. In particular, an empty space is provided in the region of the base 5 of the return-to-zero hammer 4, said hammer being inserted between the control lever 17 and the small plate 21. This type of structural characteristic makes it possible to ensure good wedging of the base 5 of the hammer between the two plane portions defined by the control elements. One can provide that the distal part of the hammer, namely that bearing the support surfaces 9 and 10, rests on adapted support surfaces of the chronograph bar.

Moreover, the control lever 17 advantageously has a pivot point located in the alignment of the respective pivot points of the return-to-zero lever 2 and hammer 4. Thus, it is provided that the post 3 extends to the inside of an adapted hole (not visible) of the control lever 17 and, preferably, to the inside of a hole 23 similar to the small plate 21.

One will note that, in this configuration, a space must be provided, between the return-to-zero lever 2 and the hammer 4, sufficient for the control lever 17 to move freely therein. Moreover, the control lever 17 has a countersink 24, shown in dotted lines in FIG. 1, to allow the movement of the pin 7 connecting the hammer to the return-to-zero lever during actuation thereof.

Activation of the control lever 17, through translation of the control member along the axis S, causes a movement of the operating-lever hook 20 acting on a rotating control element, shown here in the form of a column wheel 25.

The column wheel 25 comprises a ratchet 26, whereon the operating-lever hook 20 acts, as well as columns 27 integral with the ratchet 26 and the number of which is, preferably, equal to half the number of teeth of the ratchet. Thus, the column wheel 25 completes a rotation of one half-pitch, in the counterclockwise direction, in response to each pressure exerted on the control lever 17, one pitch corresponding to the angle separating one column 27 from the following column. A column wheel jumper (not shown) is arranged conventionally to lock the toothing of the ratchet in each of its positions, two adjacent positions being separated by one angular half-pitch.

The columns 27 cooperate with a plurality of component elements of the movement according to the present invention, which will be described in detail later, depending on the angular state of the column wheel 25 relative to the plate 1.

It should, however, be noted here that the hammer 4 does not have any direct mechanical connection with the column wheel 25. As was mentioned above, such a characteristic results in an elimination of the differences in sensations felt between a first start-up of the chronograph function and a start-up following a first measurement interval without intermediate return-to-zero.

Of course, the movement of the timepiece according to the present invention is not limited to the implementation of a column wheel as rotating control element, a conventional cam being able to be used in the alternative.

FIG. 2 shows the principal role of the column wheel 25 in the chronograph movement.

The movement comprises an axial-type coupling having a structure already known from the state of the art. The axial coupling comprises a pair of coupling clamps 28 and 29 arranged to act simultaneously on the second counter as will appear from the detailed description of FIG. 3.

Each of the clamps 28, 29 is rotatably mounted on a post 30, 31 integral with the plate 1, and comprises a first end 32, 33, near the corresponding post, arranged bearing against the first end of the other clamp. Each of the clamps 28, 29 comprises a second end bearing an inclined support surface 34, 35 designed to drive the coupling or uncoupling of the second counter.

A clamp spring (not shown) is arranged bearing against the first end 33 of the clamp 29 to exert a force thereon, this force being diagrammed by the arrow referenced F2 in FIG. 2, tending to push said clamp 29 in the direction of the first end 32 of the other clamp 28. Thus, the force F2 tends to distance the clamps 28, 29 apart from each other from the side of their second respective ends 34 and 35 to release the second counter, the position of which in FIG. 2 is diagrammed by the illustration of its axis 15.

The clamp 28 also comprises a portion 36 extending while forming a lateral protrusion pointed in the direction of the column wheel 25. The clamps 28, 29 are shown in their close position in normal lines in FIG. 2, and in their distanced position in thin lines.

One sees that, in the configuration of the column wheel 25 shown in FIG. 2, the lateral protrusion 36 of the clamp 28 is arranged bearing against a column 27 of the column wheel. The column 27 thus plays the role of a banking for the clamp 28, which results in maintaining the clamps 28, 29 in a close relative position.

Likewise, one understands that, when the control lever 17 is actuated, the column wheel 25 is driven in rotation by one half-pitch in the direction indicated in FIG. 2. This rotation drives a movement of the column 27 which is then no longer across from the lateral protrusion 36. Once the banking of the lateral protrusion 36 is removed, the clamp 28 can distance itself from the clamp 29 under the effect of the pressure F2 exerted by the coupling spring on the first end 33 of the clamp 29. This distanced position of the clamps 28, 29 is that shown in thin lines in FIG. 2.

One skilled in the art will be able to implement any adapted known means to limit the amplitude of the rotation of the clamps 28 and 29 when these clamps are remote from each other, without going outside the scope of the present invention.

Preferably, one provides an additional yoke 37 rotatably mounted on a post 38 integral with the plate 1. A first end 39 of the yoke 37 is arranged bearing against the clamp 28 while the second end 40 of the yoke is located near the free end of the return-to-zero lever 2.

Depending on whether the clamp 28 is remote from or close to the clamp 29, the yoke 37 also has two extreme positions, one of which, corresponding to the close position of the clamp 28, is shown in normal lines, while the other, corresponding to the remote position of the clamp 28, is shown in thin lines in FIG. 2.

One will note that a spring not shown is arranged in the movement according to the present invention to exert a pressure force F3 on the yoke 37 tending to maintain contact between its first end 39 and the clamp 28.

One sees that the second end 40 of the yoke 37 is only arranged across from the free end of the return-to-zero lever 2 when the clamp 28 is in its remote position. In this position of the yoke 37, it is visible in FIG. 2 that the return-to-zero lever 2 cannot be actuated and, as a result, the activation of the return-to-zero mechanism of the movement is not possible in this position.

Conversely, we see that if the return-to-zero lever 2 is pressed in, the rotation of the column wheel 25 remains possible by actuating the control lever 17, such a rotation not, however, immediately causing the distancing of the clamps 28 and 29 in this example. In fact, in this case, the clamps 28 and 29 are kept close, despite the pressure F2 of the clamp spring, under the action of the first end 39 of the yoke 37 on the clamp 28, the yoke itself being retained by locking of its second end 40 by the free end of the return-to-zero lever 2. The distancing of the clamps 28, 29 can then only be done by releasing the return-to-zero lever 2 causing the rotation of the yoke 37, due to the pressure F2 of the clamp spring on the first end 33 of the clamp 29.

The relationship between the clamps 28, 29 and the second counter as well as the start and stop of time measurements using a timepiece movement will now be explained based on FIG. 3.

Figure 3:
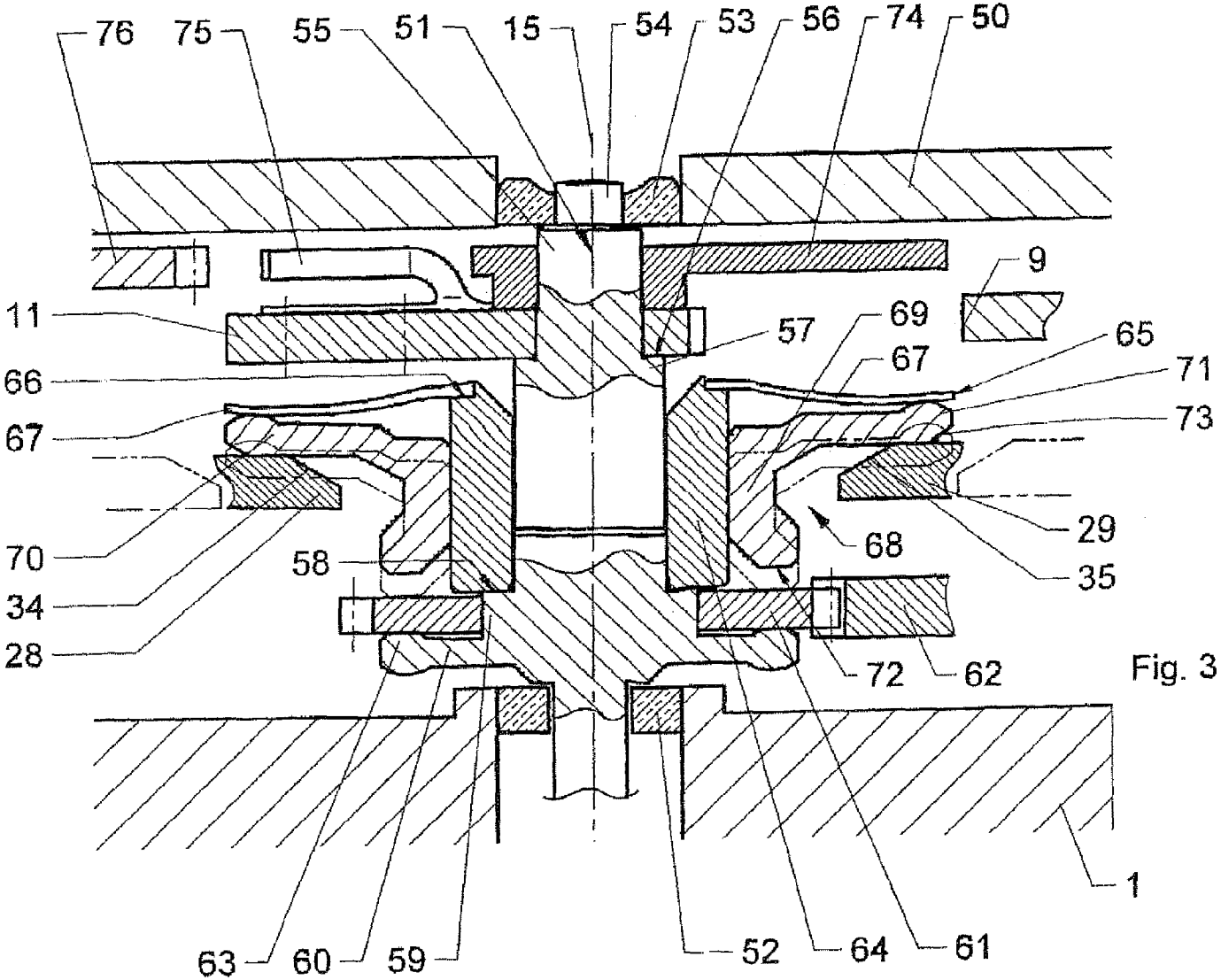
FIG. 3 is a simplified transverse cross-sectional view of the chronograph movement along line III-III of FIG. 2.

FIG. 3 shows a partial transverse cross-sectional view, along line III-III of FIG. 2, of the center of the chronograph movement according to the present invention.

The second counter is arranged in the chronograph movement between the plate 1 and a chronograph bar 50. For this purpose, the chronograph second mobile is positioned in the movement via its arbor 51, maintained coaxial to the axis of rotation 15 defined above by two jewels 52 and 53, one of which is press-fitted in the plate and the other in the chronograph bar.

While traveling along the arbor 51, from the chronograph bar 50, FIG. 3 shows a first end 54, housed in the jewel 53, followed by a first cylindrical portion 55 of the arbor 51, the latter ending with a first shoulder 56. This is followed by a second cylindrical portion 57 having a diameter larger than that of the first cylindrical portion 55, and ending with a second shoulder 58. A third cylindrical portion 59 follows the shoulder 58, this having a diameter and a length smaller than those of the first two cylindrical portions 55 and 57. The third cylindrical portion 59 ends with a generally disc-shaped step 60 integral with the arbor 51. Continuing after the step 60, the diameter of the arbor 51 narrows, before forming a pivot engaged in the jewel 52, to extend to its second free end (not shown) designed to bear a hand indicating timed seconds, above a dial.

Conventionally, a plurality of elements are arranged on the arbor 51 before its placement between the plate 1 and the chronograph bar 50.

From the plate side of the arbor 51, one finds a second mobile wheel 61 arranged around the third cylindrical portion 59 of the arbor 51, bearing against an annular clot 63 of the step 60. The wheel 61 is thus mounted freely in rotation relative to the arbor 51. The wheel 61 is also arranged permanently engaged with an element 62 of the going train of the movement, the latter only being partially diagrammed in FIG. 3. The going train element 62 can, depending on different known variations, correspond to different parts of the movement without going outside the scope of the present invention such as, for example, a wheel driving the chronograph, integral with a second mobile of the going train, or an escape-pinion directly. Thus, one should provide adapted means to drive the wheel 61, corresponding to the desired rhythm for the rotation of the second wheel.

A bush 64 is press-fitted on the arbor 51, arranged abutting against the second shoulder 58, in particular to allow wedging of the wheel 61 in the longitudinal direction of the arbor 51, with a small play.

The bush 64 also bears a spring 65 having a circular central opening, via which it is press-fitted in an adapted recess 66 of the end of the bush opposite the location of the wheel 61. The bush 64 and the spring 65 are integral with each other.

Preferably and in a known manner, the spring 65 has a plurality of radial arms 67 curved in the direction of the plate 1, under the effect of a prestressing.

A ring 68 is also engaged freely around the bush 64. The ring 68 comprises a first tube-shaped portion 69, whereof one end is extended by a second portion, made in the form of an annular surface 70 extending in a plane substantially parallel to the plane of the wheel 61. The diameter of the annular surface 70 is substantially equal to the length of the arms 67 of the spring 65. The annular surface 70 has an annular boss 71, in the region of its periphery, bearing against which the arms 67 are pre-stressed.

The second end of the tube 69, located on the side of the wheel 61, has an annular support surface 72 arranged substantially across from the annular clot 63 of the step 60.

Thus, one understands that, under the effect of the pressure exerted by the spring 65 on the annular surface 70, the ring 68 is pushed back in the direction of the wheel 61, which then finds itself compressed between the annular clot 63 of the step 60, on one hand, and the support surface 72 of the ring 68, on the other.

The mechanical properties of the spring 65, the ring 68, the wheel 61 and the annular clot 63 are adjusted without particular difficulty for one skilled in the art, during production of the movement, such that the pressure of the spring 65 on the ring 68 is sufficient, when locked, for the wheel 61 to be made integral in rotation with the arbor 51. In FIG. 3, we have shown such a locked situation of the ring 68 in broken lines. This situation corresponds to a period measuring a time interval during which a hand indicating the second, supported by the arbor 51, is driven in rotation when the movement according to the present invention is implemented in a timepiece.

The respective ends of the clamps 28 and 29 have been illustrated in FIG. 3 and, in particular, the inclined support surfaces 34 and 35 are visible on both sides of the ring 68. The clamps 28, 29 have been shown in their close position, in solid lines, and in their remote position, in broken lines, the latter position corresponding to the locked position of the ring 68, as explained above.

An illustration of this type makes it possible to see that, when the clamps 28, 29 are distanced, they are not in contact with the ring 68, this ring then exerting pressure on the wheel 61. Conversely, the periphery of the annular surface 70 has a chamfer 73 designed to cooperate with the inclined support surfaces 34, 35 of the clamps when these are brought from their remote position toward their close position. During a movement of this type, the support surfaces 34 and 35 slide under the annular surface 70 while distancing the ring 68 from the step 60, by exerting a force opposing the pressure of the spring 65 on the ring 68. The ring, while distancing itself from the step 60, releases the wheel 61, which can once again slide in rotation relative to the arbor 51. Thus, driving of the wheel 61 from the going train element 62 is no longer transmitted to the arbor 51.

It is important to note that at the same time, the friction taking place, on one hand, between the clamps 28, 29 and the annular surface 70 and, on the other hand, between the annular boss 71 and the arms 67 of the spring 65, are sufficient to ensure rapid and precise rotational immobilization of the arbor 51 when the clamps 28 and 29 are close together. Of course, the form and control of the clamps are also determining in achieving this result.

Moreover, the return-to-zero heart 11 of the second counter, described in relation to FIG. 1, is press-fitted on the first cylindrical portion 55 so as to abut against the first shoulder 56 of the arbor 51. A counterpoise 74, of the conventional type and making it possible to balance the contribution of the return-to-zero heart 11 at the time of inertia of the mobile relative to the arbor 51, is press-fitted on the first cylindrical portion 55 until it abuts against the heart.

One also sees in FIG. 3 that the return-to-zero heart 11 bears a finger or index 75 designed to drive an inter-counter wheel 76 in a known manner, said wheel being only partially illustrated diagrammatically and being designed, itself, to drive the minute counter mobile whereof the heart 12 is visible in FIG. 1.

We have also shown, in FIG. 3, the support surface 9 of the return-to-zero hammer 4, when said hammer is in its raised or locking position.

We will now describe the operation of the movement which has just been described, based on FIGS. 1 to 3.

Initially, we consider that the configuration of the chronograph movement according to the present invention, locked, corresponds to the illustration of FIGS. 1 to 3, in thick lines in FIGS. 1 and 2 and in solid lines in FIG. 3.

Thus, the return-to-zero lever 2 and hammer 4 are in their locked, i.e. raised, position, while the lateral protrusion 36 of the clamp 28 is arranged bearing against a column 27 of the column wheel 25. As a result, the clamps 28, 29 are in their close position, the ring 68 being remote from the wheel 61. As previously mentioned, the arbor 51 of the second counter is not driven by the going train element 62, in this situation, due to insufficient frictional forces between the wheel 61 and the step 60 under the action of the clamps 28, 29 on the spring 65, via the ring 68. Initially, the hands indicating the second 13 and minute 14 are therefore located, immobile, across from the positions corresponding to a null time measurement.

From this configuration, the time measurement can be triggered conventionally, i.e. by an action on the external control member (in S) acting on the control lever 17. Such an action causes the column wheel 25 to turn by one half-pitch and distance the clamps 28 and 29 from each other. The distancing of the clamps causes the release of the ring 68 which, under the pressure of the spring 65, is pressed against the wheel 61. The latter, permanently driven by the going train element 62, then transmits its movement, through significant friction on the step 60, to the arbor 51 which begins to move. The finger 75 acts on the inter-counter wheel 76 to retransmit the rotational movement of the second counter to the minute counter.

Alternatively and preferably, the time measurement can be initiated by an action on the return-to-zero lever 2, prior to an action on the external control member (in S) acting on the control lever 17. In this case, the return-to-zero hammer 4 is arranged abutting against the return-to-zero hearts 11 and 12, preventing any rotation of the second and minute counters. However, unlike the conventional method for throwing into gear described above, the prior action on the return-to-zero lever 2 results in locking the yoke 37 in its position shown in solid lines in FIG. 2. Thus, when the column wheel 25 is driven in rotation following an action on the control lever 17, the lateral protrusion 36 of the clamp 28 is no longer held by a column 27, but the clamp 28 is, in spite of everything, immobilized by the first end 39 of the yoke 37. At the same time, the clamp 28 acts on the clamp 29 by its end 32, such that the two clamps remain in their close position, in which the driving of the second and minute counters is neutralized by sliding of the wheel 61 relative to the arbor 51. When the return-to-zero lever 2 is released, the yoke 37 is again free to turn around its post 38 to place itself in the configuration shown in thin lines in FIG. 2. At the same time, the clamps 28 and 29 distance themselves from each other, under the effect of the pressure F2 of the coupling spring on the clamp 29 itself acting on the end 32 of the clamp 28 so as to distance the latter part. Thus, the release of the return-to-zero lever 2 causes the coupling of the arbor 51 with the wheel 61 driven by the going train via the ring 68, as explained above.

When a time measurement is in progress, the yoke 37 is in its position shown in thin lines in FIG. 2, and provides a locking function of the return-to-zero lever via its second end 40.

Thus, the chronograph movement according to the present invention offers its user the possibility of starting a time measurement using two different sequences of manipulation of the external control members according to the user's preferences, either by simple pressure on the control member in S, or sustained pressure on the return-to-zero organ in R, followed by pressure on the control member in S then a release of the return-to-zero organ.

A new action on the control lever 17, from the measurement situation above, causes the column wheel 25 to rotate by one half-pitch, one column 27 of said column wheel exerting pressure on the lateral protrusion 36 of the clamp 28 tending to push said clamp back toward its close position. At the same time, the clamp 29 is also pushed toward its close position under the effect of the pressure applied to the lateral protrusion 36, opposed to the pressure F2 of the coupling spring, transmitted by the clamp 28 via its end 32.

Bringing the clamps 28, 29 close together causes the uncoupling of the arbor 51 relative to the wheel 61 and ensures the immobilization of the hands 13 and 14 indicating time measurements.

By moving toward its close position, the clamp 28 releases the yoke 37 which resumes its locked position, under the effect of the pressure force F3, as shown in solid lines in FIG. 2.

At this stage, the result of the time measurement can be read on the display means of the timepiece integrating the movement according to the present invention.

The following step may either be to continue the time measurement or to return the second and minute counters to zero.

Continuing the time measurement is done by actuating the control lever 17, which causes the column wheel 25 to rotate and brings about all of the consequences described above in relation with the first start, with the exception that the initial position of the second 13 and minute 14 hands is not at zero, but corresponds to the value of the first measured time interval.

It should be noted that starting the time measurements, on one hand, from the null position of the counters and, on the other hand, from an intermediate position corresponding to a pause between two measurements without return to zero, only differ by the positions of the chronograph mobiles.

Indeed, when the chronograph counters are stopped, the configurations of the movement according to the present invention are the same, whether the counters are in their null position or in an intermediate position following a first measurement.

Thus, an action on the control lever 17 under these conditions acts on the same component elements of the movement and in the same way, in either case. As a result, the user actuating the control member of a timepiece integrating the movement according to the present invention, to activate the time measurement, does not feel a difference depending on whether or not the chronograph counters are at zero.

A characteristic of this type is advantageous from a perspective of comfort provided for the user, insofar as the difference in the force to be exerted on a control member of a movement of the prior art is noticeable, depending on whether a time measurement is activated from the null state of the chronograph counters or from a non-null state. The additional force to be provided corresponds to the raising of the return-to-zero hammer(s), the locking position of which is generally the lowered position in the movements of the prior art.

From the stopped position, a return-to-zero of the second and minute counters can be done by an action on the return-to-zero lever 2. Such an action causes the movement of the return-to-zero hammer 4, which strikes the hearts 11 and 12 of the chronograph counters to replace the hands in their locked position, conventionally.

One may note that at the time of activation of the return-to-zero, the clamps 28 and 29 are in their close position and ensure the immobilization of the chronograph mobiles. When the return-to-zero hammer 4 strikes the hearts 11 and 12, the arbor 51 is driven in rotation due to the rotation of the heart 11, this being done via a sliding of the arms 67 of the spring 65 on the annular boss 71 of the ring 68, under the effect of the couple transmitted by the hammer 4 to the arbor 51.

Furthermore, one skilled in the art can implement a jumper to ensure the immobilization of the minute counter, conventionally, when a time measurement is not activated. The jumper can thus be raised by known means to release the minute counter during return-to-zero operations.

The preceding description corresponds to one preferred embodiment of the invention described as a non-limiting example. In particular, the forms shown and described for the various component elements of the chronograph movement are non-limiting.

Of course, the implementation of the characteristics described here is also possible in a cam-type chronograph movement without going outside the scope of the invention. Likewise, one skilled in the art will not encounter any particular difficulties in adapting this teaching to the production of a chronograph movement also comprising an hour counter, for example.

The invention claimed is:

1. A clockwork movement with chronograph function to for time measuring comprising:

a going train, at least one second counter comprising a chronograph second mobile designed to support an organ for analog display of the second of the measured time, a control lever designed to be actuated by a first control member to alternatively activate or deactivate a time measurement, coupling means for connecting or not connecting said second mobile to said going train in response to an action on said control lever, selective locking means to lock said second counter in response to an action on said control lever, return-to-zero means for said second counter comprising at least one mobile return-to-zero element designed to be moved by a second control organ, at least between a first, locked position, and a second, active position, said mobile return-to-zero element being configured to act on said second counter in said second position, wherein it also comprises elastic means at least indirectly exerting a return force on said return-to-zero means, the movements of said mobile return-to-zero element being controlled exclusively by said second control member, from said locked position toward said active position, and by said elastic means, from said active position toward said locked position, and wherein said control lever is able to be actuated while said mobile return-to-zero element is in said active position, such that the driving of said second counter only effectively starts in response to a release of said mobile return-to-zero element from said active position.

2. The clockwork movement according to claim 1, wherein it also comprises a rotating control element able to have at least one first and one second different states, the passage from one state to the other happening in response to an action of said control lever, said rotating control element being at least indirectly connected to:

said coupling means, such that these are coupled in said first state and uncoupled in said second state, and said locking means, such that these are inactive in said first state and active in said second state.

3. The clockwork movement according to claim 1, wherein said rotating control element is a column wheel.

4. The clockwork movement according to claim 1, wherein said coupling means also serve as said locking means.

5. The clockwork movement according to claim 4, wherein said coupling means also comprise an axial coupling arranged on said second counter and actuated by a pair of clamps whereof the separation depends on the state of said rotating control element.

6. The clockwork movement according to claim 5, wherein said second mobile comprises a step against which is arranged a second wheel permanently engaged with an element of said going train, said second wheel being able to turn freely in relation to said second mobile, a ring being mounted coaxial on said second wheel, a spring integral with said second mobile being arranged bearing against said ring to exert on the latter, depending on the separation of said clamps, a pressure force to press said ring against said second wheel, said second wheel itself exerting pressure against said step to allow the driving via friction of said second mobile from said second wheel.

7. The clockwork movement according to claim 2, wherein it also comprises a locking yoke arranged so as to lock said mobile return-to-zero element in said first locked position when said rotating control element is in said first state.

8. The clockwork movement according to claim 7, wherein said locking yoke has a first end arranged in contact with one of the clamps of the coupling.

9. The clockwork movement according to claim 8, wherein said locking yoke has a second end arranged in the region of said return-to-zero means.

10. A timepiece with chronograph function comprising a movement with chronograph function to for time measuring, said movement comprising:

a going train, at least one second counter comprising a chronograph second mobile designed to support an organ for analog display of the second of the measured time, a control lever designed to be actuated by a first control member to alternatively activate or deactivate a time measurement, coupling means for connecting or not connecting said second mobile to said going train in response to an action on said control lever, selective locking means to lock said second counter in response to an action on said control lever, return-to-zero means for said second counter comprising at least one mobile return-to-zero element designed to be moved by a second control organ, at least between a first, locked position, and a second, active position, said mobile return-to-zero element being configured to act on said second counter in said second position, wherein said movement also comprises elastic means at least indirectly exerting a return force on said return-to-zero means, the movements of said mobile return-to-zero element being controlled exclusively by said second control member, from said locked position toward said active position, and by said elastic means, from said active position toward said locked position, and wherein said control lever is able to be actuated while said mobile return-to-zero element is in said active position, such that the driving of said second counter only effectively starts in response to a release of said mobile return-to-zero element from said active position.

* * * * *

UNITED STATES PATENT AND TRADEMARK OFFICE

CERTIFICATE OF CORRECTION

PATENT NO. : 7,597,471 B2
APPLICATION NO. : 12/094792
DATED : October 6, 2009
INVENTOR(S) : Perret et al.

It is certified that error appears in the above-identified patent and that said Letters Patent is hereby corrected as shown below:

On the title page amend item (22) to read as follows:
--(22) PCT Filed: Nov. 21, 2006--

Signed and Sealed this

Seventeenth Day of November, 2009

David J. Kappos

David J. Kappos
*Director of the United States Patent and Trademark Office*